US008827198B1

(12) United States Patent
Steadman, Sr.

(10) Patent No.: US 8,827,198 B1
(45) Date of Patent: Sep. 9, 2014

(54) FISHING LINE UNWINDER

(76) Inventor: Alfonza Steadman, Sr., Akron, OH (US)

( * ) Notice: Subject to any disclaimer, the term of this patent is extended or adjusted under 35 U.S.C. 154(b) by 540 days.

(21) Appl. No.: 13/096,768

(22) Filed: Apr. 28, 2011

Related U.S. Application Data

(60) Provisional application No. 61/329,826, filed on Apr. 30, 2010.

(51) Int. Cl.
*B65H 75/14* (2006.01)
*B65H 75/22* (2006.01)
*B65H 75/28* (2006.01)

(52) U.S. Cl.
USPC ..... 242/608.4; 242/587.2; 242/613.2; 242/118.6; 242/125.1; 242/902

(58) Field of Classification Search
USPC ..... 242/600, 608, 608.2–608.4, 609–609.2, 242/118, 118.4, 118.61–118.62, 902, 242/613–613.2, 125–125.1, 579, 587, 587.2
See application file for complete search history.

(56) References Cited

U.S. PATENT DOCUMENTS

| | | | | | |
|---|---|---|---|---|---|
| 1,805,426 | A | * | 5/1931 | Vanatta | 206/227 |
| 2,262,665 | A | * | 11/1941 | Cavanaugh | 242/125.1 |
| 2,438,440 | A | * | 3/1948 | Hirsch | 242/118.4 |
| 2,924,395 | A | * | 2/1960 | Steele | 242/609.1 |
| 3,717,315 | A | * | 2/1973 | Kovaleski | 242/609.1 |
| 4,196,864 | A | | 4/1980 | Cole | |
| 4,951,890 | A | | 8/1990 | Sossamon | |
| 6,015,111 | A | | 1/2000 | Berke | |
| 6,102,319 | A | | 8/2000 | Annabel et al. | |
| 6,648,262 | B1 | | 11/2003 | Huffman | |
| 2004/0035973 | A1 | | 2/2004 | Henrion | |

* cited by examiner

*Primary Examiner* — William E Dondero
(74) *Attorney, Agent, or Firm* — George P. Huang; Fay Sharpe LLP

(57) ABSTRACT

A spool device for unwinding fishing line from a reel is disclosed. The spool device is intended to be attached to a power drill which rotates the spool. The spool device is made from two spool portions. Each spool portion has a shaft with a central end and a distal end. A flange extends from the distal end of the shaft. The two spool portions are joined at their central ends and form a groove in the middle of the resulting spool. A bolt and fastener are used to mate the two spool portions together and form a single unit that rotates. The groove grips the fishing line during rotation. The spool portions can be separated to remove the unwound fishing line.

4 Claims, 4 Drawing Sheets

FISHING LINE UNWINDER

The present disclosure claims priority to U.S. Provisional Patent Application Ser. No. 61/329,826, filed on Apr. 30, 2010. The entire disclosure of that application is fully incorporated by reference herein.

BACKGROUND

The present disclosure relates to a device for unwinding fishing line from a fishing reel. Professional anglers and hobby fishermen alike know how time consuming it can be to unwind fishing line from a fishing rod or pole by hand. Even so, this is a necessary task if the fishing line is rotted or if the fisherman wishes to exchange the line for one with a different weight, material, length, or brand. It would be desirable to provide a device that makes it easier for a person to remove and discard old or unwanted fishing line.

BRIEF DESCRIPTION

The present disclosure provides consumers with a device for efficiently removing old fishing line from a fishing reel. The consumer simply attaches the line to the device, attaches the device to a power drill, and activates the power drill to wind the line around the device and off the fishing reel. The device is made of two pieces that can be separated, allowing the consumer to remove the line and throw it away. Any fisherman could benefit from using this time saving and easy-to-use device.

Disclosed in embodiments herein is a device for removing fishing line from a reel, comprising: a fastener, a bolt, a first spool portion and a second spool portion. Each spool portion has a shaft with a central end and a distal end, the central end being tapered to form a stop wall; a flange extending from the distal end of the shaft, and a bore extending through the shaft from the central end to the distal end. When the two spool portions are combined, the stop walls form a groove.

In some embodiments, the central end of the shaft of each spool portion has a trapezoidal cross-section. In other embodiments, the central end of the shaft of each spool portion has a channelled cross-section.

The bore may have a circular cross-section.

The flange may extend perpendicularly from the distal end of the shaft.

In some embodiments, the diameter of the bore at the central end is greater than the diameter of the bore at the distal end.

The fastener may be a nut, such as a wingnut.

Also described in embodiments is a device for removing fishing line from a reel. The device comprises a bolt, a fastener, and a spool. The spool has a shaft, a groove in the middle of the shaft, a first flange extending from a first end of the shaft, and a second flange extending from a second end of the shaft. The bolt passes through a central axial bore in the spool. The spool can be separated into two substantially identical spool portions.

The groove may have a chevron shape or a channel shape.

The bore may have a circular cross-section.

The diameter of the bore at the middle of the shaft may be greater than the diameter of the bore at the first and second ends of the shaft.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
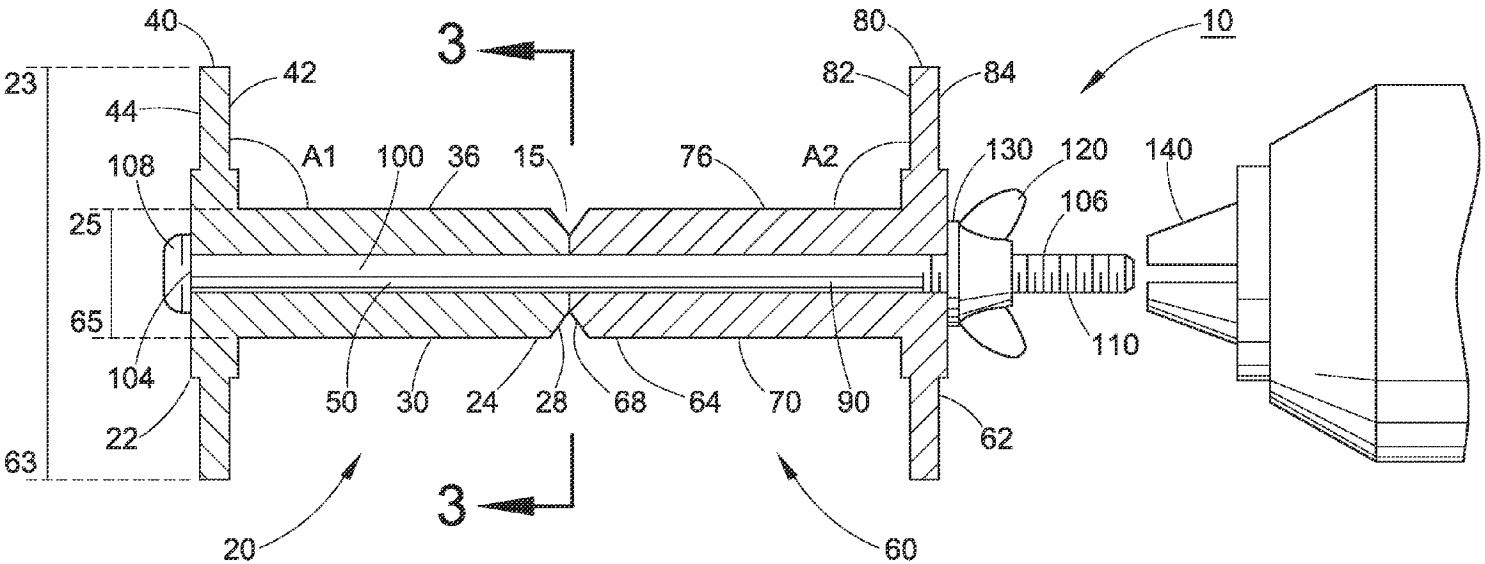
FIG. 1 is a cross-sectional view of a first embodiment of the fishing line unwinder of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The fishing line unwinder of the present disclosure is a spool-shaped device that attaches to a power drill for quickly and conveniently removing old or unwanted fishing line from a fishing reel. The device comprises two halves that are joined together by a long bolt running through the center of both halves and secured on one end with a fastener. The user connects one end of the bolt to a power drill and ties the fishing line around the center of the device, where a groove holds the fishing line. The drill spins the device. The user then removes the nut and bolt, separating the spool into the two halves, allowing the fishing line to easily slide off for disposal.

Figure 2:
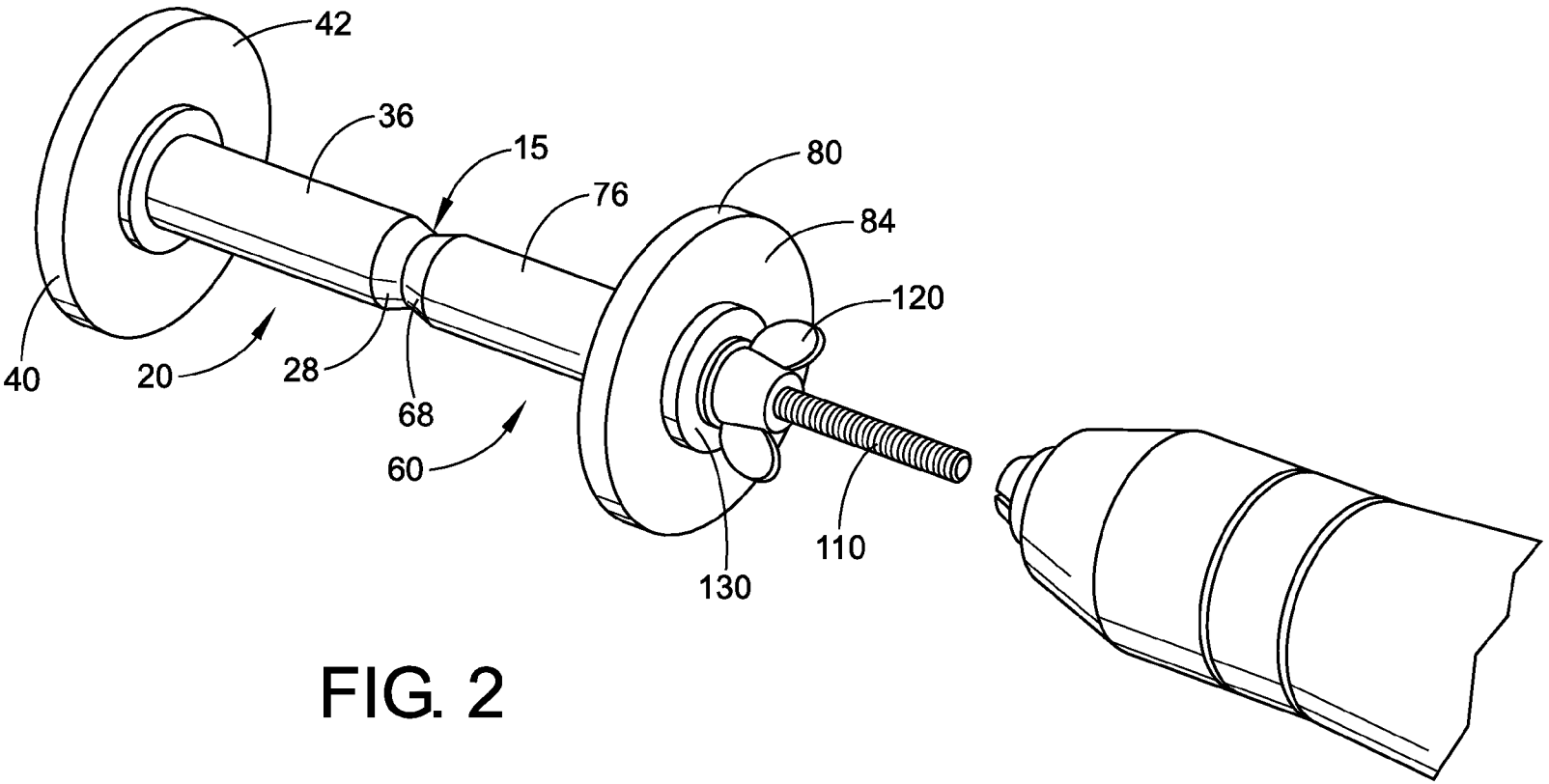
FIG. 2 is a perspective view of the first embodiment of FIG. 1

FIG. 1 and FIG. 2 are views of a first embodiment of the fishing line unwinder 10 of the present disclosure. The fishing line unwinder 10 is formed from a first spool portion 20 and a second spool portion 60. The first spool portion 20 has a longitudinal shaft 30 with a distal end 22 and a central end 24. The central end 24 of the shaft is tapered to form a stop wall 28. Put another way, the central end of the shaft has a trapezoidal cross-section. The stop wall 28 is part of a groove 15, which is discussed further herein. A flange 40 extends perpendicularly from the distal end 22 of the shaft 30. Put another way, the flange extends radially from the shaft. The flange 40 has an inner surface 42 and an outer surface 44 which are usually parallel to each other. However, it is contemplated that the outer surface could be shaped to create a unique aesthetic look. The inner surface 42 of the flange 40 is generally perpendicular to the outer surface 36 of the shaft 30, as indicated by angle A1. A central axial bore 50 extends through the shaft from the central end 24 to the distal end 22.

The diameter 23 of the flange at the distal end is greater than the diameter 25 of the central end.

Figure 3:
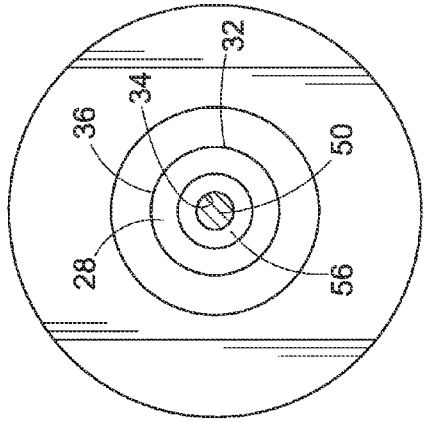
FIG. 3 is an axial view of a spool portion of the first embodiment of FIG. 1.

As seen in FIG. 3, the axial bore 50 is circular in cross-section. The shaft 30 is also seen as being formed from a cylindrical sidewall 32 having an outer surface 36 and an inner surface 34 along the bore 50. On the central end, the sidewall is divided into a peripheral surface 56 and the stop wall 28.

Similarly, the second spool portion 60 has a shaft 70 with a distal end 62 and a central end 64. The central end 64 of the shaft is tapered to form a stop wall 68. The stop wall forms the other half of the groove 15. A flange 80 extends from the distal end 62 of the shaft 70. The flange 80 has an inner surface 82 and an outer surface 84 which are generally parallel to each other. The inner surface 82 of the flange is generally perpendicular to the outer surface 76 of the shaft, as indicated by angle A2. An axial bore 90 extends through the shaft from the central end 64 to the distal end 62. The diameter 63 of the flange at the distal end is greater than the diameter 65 of the shaft at the central end. The first and second spool portions 20, 60 are generally identical in size and shape. Put another way, diameters 23 and 63 are equal, and diameters 25 and 65 are equal.

The device 10 is assembled by placing the central end 24 of the first spool portion 20 adjacent to or abutting the central end 64 of the second spool portion 60. A bolt 100 extends through the bores 50, 90 of each spool portion. The bolt 100 has a head 108 on the first end 104 of a shank 102 and a thread 110 on the second end 106 of the shank 102. The bolt 100 is used in combination with a fastener 120, depicted here as a wingnut, to join and lock the spool portions 20, 60 together in an assembled condition. Compressive force joins the two spool portions 20, 60, bolt 100, and fastener 120 together as a single unit. If desired, a washer 130 may also be placed between the spool portion 60 and the fastener 120. The threaded end 106 of the bolt extends beyond the flange 80 of a spool portion 60, and can be gripped by the chuck 140 of a power drill in order to rotate the two spool portions as a single unit.

In the device of FIG. 1, the stop walls 28, 68 of the two spool portions together form a groove 15. This groove can be described as having a chevron shape or a "V" shape. When the fishing line is initially wound onto the spool, the fishing line is wound within the groove as well. During rotation of the spool, the edges of the groove "grip" the fishing line and allow the line to be taken up on the spool.

Figure 4:
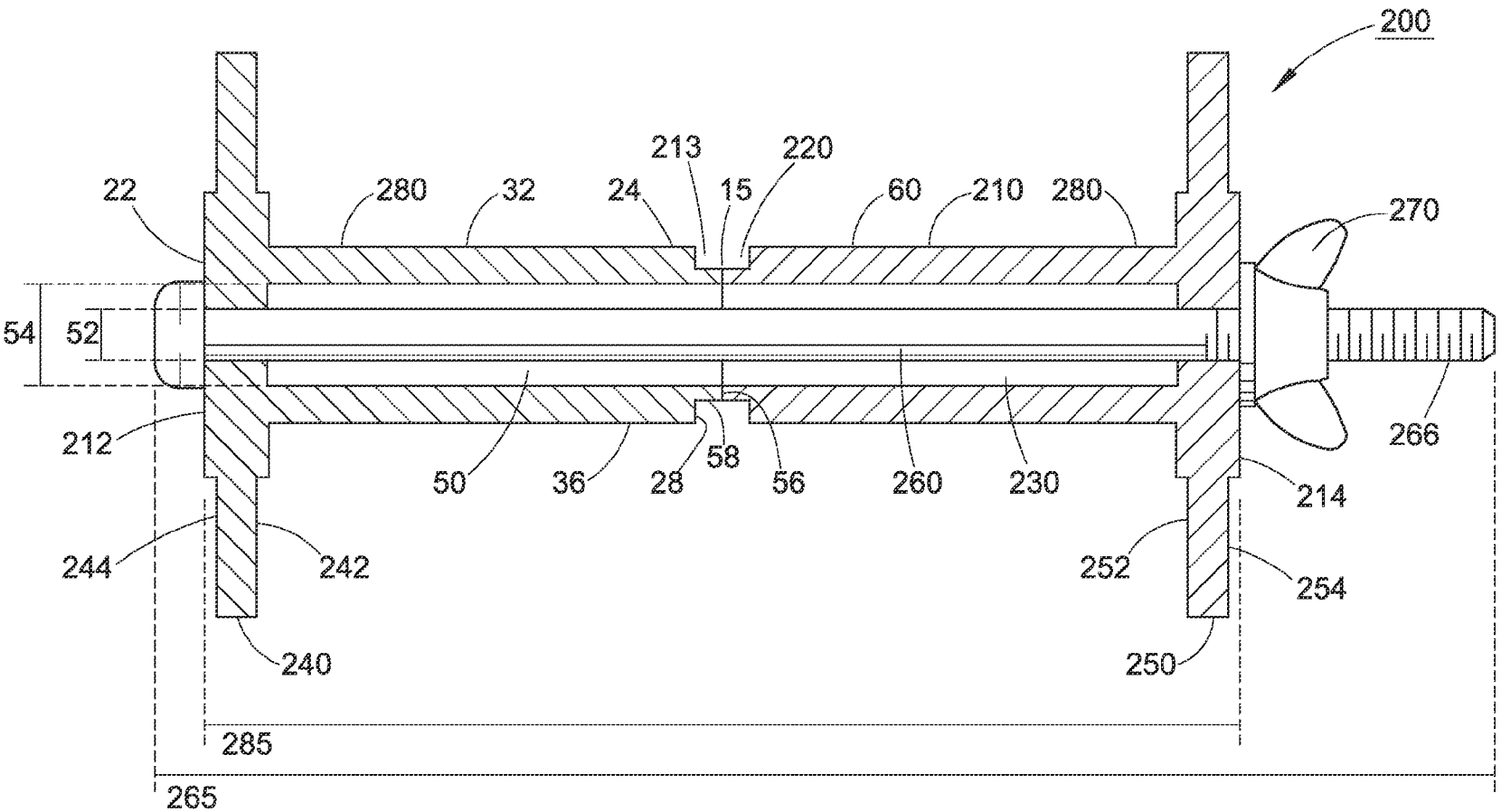
FIG. 4 is a cross-sectional view of a second embodiment of the fishing line unwinder of the present disclosure.

FIG. 4 is a cross-sectional view of a second embodiment. This embodiment shows some variations on the central end 24 and the bore 50. Here, the central end 24 of the shaft has a channelled cross-section. Put another way, the central end 24 has a peripheral surface 56 which abuts the other spool portion 60. A bottom wall 58 extends into the shaft sidewall 32 from the peripheral surface 56, and a stop wall 28 extends from the bottom wall 58 to the outer surface 36 of the shaft. The resulting groove 15 formed by the two spool portions 20, 60 has a channel shape. Next, the bore 50 is shaped differently from the bore shown in FIG. 1. In FIG. 1, the bore had a constant diameter. Here, the diameter 54 of the bore at the central end 24 is greater than the diameter 52 of the bore at the distal end 22. This difference may be due to differences in the manufacturing process.

Alternatively, referring to FIG. 4, the device can also be described as a spool 200. The spool has a cylindrical shaft 210 with a groove 220 in the middle 213 of the shaft. A first flange 240 extends from the first end 212 of the shaft. A second flange 250 extends from the second end 214 of the shaft. Each flange 240, 250 has an inner surface 242, 252 and an outer surface 244, 254 which are generally parallel to each other. The inner surface 242, 252 of each flange is perpendicular to the axis of the cylindrical shaft 210. A bolt 260 passes through a central axial bore 230 in the shaft 210. The diameter of the bore 260 at the middle 213 of the shaft is greater than the diameter of the bore at the first and second ends 212, 214 of the shaft. A fastener 270 is attached to the threaded end 266 of the bolt. The spool can be separated into two substantially identically shaped spool portions 280.

The spool portions of the fishing line unwinding device of the present disclosure can be molded from plastics, such as polyvinyl chloride (PVC), or other suitable materials.

The dimensions of the device may vary. However, referring to FIG. 4, the bolt 260 has a length 265 which is greater than the combined lengths 285 of the two spool portions. Put another way, one end 266 of the bolt protrudes beyond the flange at least one inch. This ensures that the threaded end of the bolt is adequate for insertion into the chuck of a power drill. In embodiments, the diameter of the flange (numeral 23 in FIG. 1) is from about 2 inches to about 4.5 inches. The diameter of the shaft (numeral 25 in FIG. 1) is from about one-quarter inch to about 1 inch. The bolt typically has a length of about 6.25 inches. The overall spool (numeral 285 in FIG. 4) has a length of from about 4 to about 5 inches. In embodiments, the groove has a depth of from about one-quarter inch to about one-half inch (measured radially), including in specific embodiments a depth of about ⅜ inch.

Figure 5:
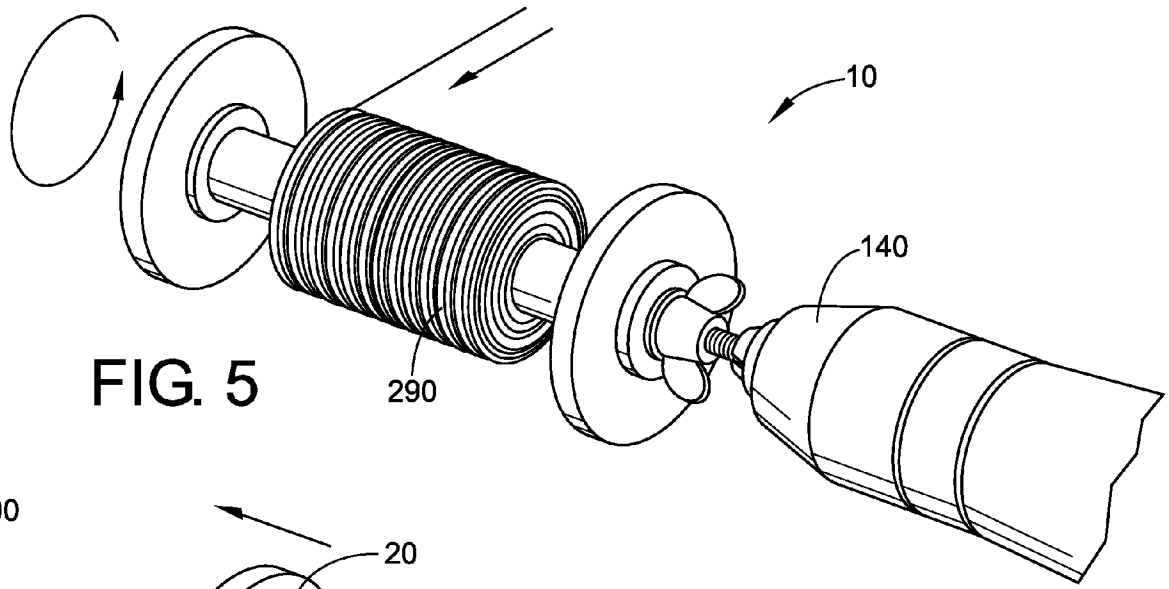
FIG. 5 is a perspective view showing fishing line being wound onto the fishing line unwinder.

The preferred method of using the spool device of the present disclosure begins with attaching the fishing line to the spool device by winding the free end of the line around the spool, making sure that the line passes through the groove. The spool device is attached to the power drill either before or after the fishing line is attached to the spool device. The power drill is then activated to rotate the spool device, thereby unwinding fishing line from the fishing reel. This is shown in FIG. 5.

Figure 6:
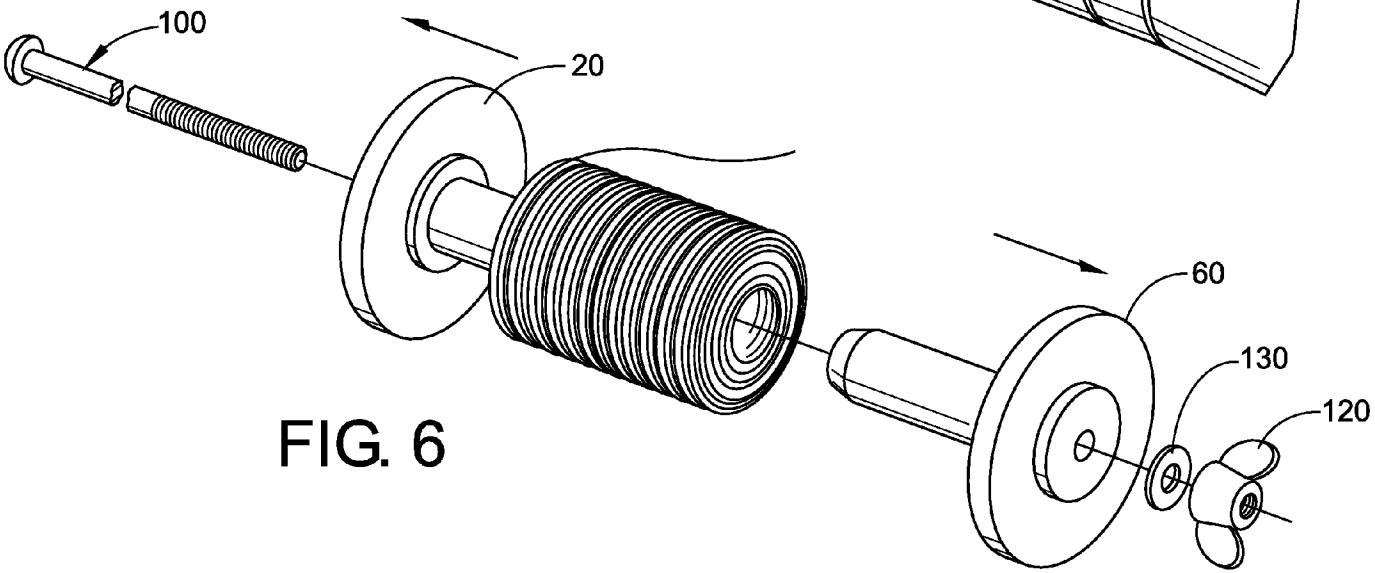
FIG. 6 is a perspective view showing the fishing line unwinder being disassembled to remove the fishing line.

After the winding of the fishing line on the spool device is complete, the bolt and nut are removed to allow the two spool portions to be separated. The fishing line bundle can then be easily slid off the shaft and discarded. This is shown in FIG. 6.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A device for removing fishing line from a reel, comprising:

a first spool portion and a second spool portion, each spool portion having:

a shaft with a central end, a distal end, and an outer surface, the central end being tapered to form a stop wall and a peripheral surface, wherein the central end of the shaft has a trapezoidal cross-section;

a flange extending from the distal end of the shaft, having an inner surface generally perpendicular to the outer surface of the shaft, and having an outer surface parallel to the inner surface; and a bore extending through the shaft from the central end to the distal end, the bore having a circular cross-section;

a bolt; and a fastener.

2. The device of claim 1, wherein the fastener is a wingnut.

3. The device of claim 1, wherein the bolt has a length that is greater than the combined lengths of the first and second spool portions by at least one inch.

4. The device of claim 1, wherein the diameter of the flange is from about 2 inches to about 4.5 inches, and the diameter of the shaft is from about one-quarter inch to about 1 inch.

* * * * *